US012623874B1

(12) United States Patent
Pittman

(10) Patent No.: US 12,623,874 B1
(45) Date of Patent: May 12, 2026

(54) PAPER WEB WINDING: ROLL QUALITY IMPROVEMENT THROUGH THE MAXIMIZATION OF COUPLING BETWEEN DRIVE ROLLS AND DRIVEN BUILT PAPER ROLL

(71) Applicant: Stephen Donald Pittman, Lewiston, ID (US)

(72) Inventor: Stephen Donald Pittman, Lewiston, ID (US)

( * ) Notice: Subject to any disclaimer, the term of this patent is extended or adjusted under 35 U.S.C. 154(b) by 51 days.

(21) Appl. No.: 19/017,261

(22) Filed: Jan. 10, 2025

(51) Int. Cl.
*B65H 18/26* (2006.01)
*B65H 18/10* (2006.01)
*B65H 23/04* (2006.01)

(52) U.S. Cl.
CPC ..... *B65H 18/103* (2013.01); *B65H 18/26* (2013.01); *B65H 23/044* (2013.01); *B65H 2513/10* (2013.01); *B65H 2513/11* (2013.01); *B65H 2557/23* (2013.01); *B65H 2557/264* (2013.01); *B65H 2557/63* (2013.01)

(58) Field of Classification Search
CPC ..... B65H 18/10; B65H 18/20; B65H 18/26; B65H 18/103; B65H 26/044
See application file for complete search history.

(56) References Cited

U.S. PATENT DOCUMENTS

| | | | | |
|---|---|---|---|---|
| 3,858,820 A * | 1/1975 | Crouse | B65H 23/1955 | 242/534 |
| 4,496,112 A * | 1/1985 | Olsson | B65H 18/145 | 242/414.1 |
| 4,811,915 A * | 3/1989 | Smith | B65H 18/26 | 242/541.6 |
| 5,806,783 A * | 9/1998 | Turunen | B65H 18/20 | 242/541.5 |
| 6,089,496 A * | 7/2000 | Dorfel | B65H 18/00 | 242/541.5 |
| 10,351,376 B2 * | 7/2019 | Bartolini | B65H 18/025 | |
| 10,526,155 B2 * | 1/2020 | Paanasalo | B65H 18/10 | |
| 10,961,071 B2 * | 3/2021 | Talvitie | B65H 18/20 | |

* cited by examiner

*Primary Examiner* — Sang K Kim

(57) ABSTRACT

A System and Method for Adaptive Paper Web Winding that adjusts Operational Parameters, including torque, pressure, tension, acceleration, Jerk Rate, and sheet speed, in response to Operational Data and feedback. The system, in one embodiment, comprises a Front Drum with adjustable torque control, a Rider Roll with variable pressure regulation, an Unwind Section with tension control, and a Control Unit configured to maximize coupling between drive rolls and driven built paper roll. The method involves detecting the Coefficient of Friction of a Paper Web, then adjusting Operational Parameters in response to Operational Data and feedback. This invention improves efficiency and reliability in paper winding operations by automating adjustments to accommodate variations in the Coefficient of Friction of a Paper Web.

20 Claims, 2 Drawing Sheets

PAPER WEB WINDING: ROLL QUALITY IMPROVEMENT THROUGH THE MAXIMIZATION OF COUPLING BETWEEN DRIVE ROLLS AND DRIVEN BUILT PAPER ROLL

CROSS-REFERENCE TO RELATED APPLICATIONS

This application claims no priority to any prior application.

FIELD OF THE INVENTION

The present invention relates to material winding systems for paper products. It introduces an adaptive system that dynamically adjusts Operational Parameters such as torque, pressure, tension, acceleration and Jerk Rate, or sheet speed to maximize coupling between drive rolls and the driven built paper roll. The system and method addresses challenges unique to paper materials, including, but not limited to, unexpected Slippage, Interweaving, excessive vibration, and operational inefficiencies.

BACKGROUND OF THE INVENTION

Paper manufacturing and processing industries rely on material winding systems to produce rolls of paper and its derivatives, such as coated sheets, uncoated sheets, or laminated paper. The quality of these rolls depends on maintaining proper Frictional Engagement between the paper surface and drive rolls. Standard industry practice is to allow Slippage (dynamic Coefficient of Friction). The goal of this invention is to maximize the Frictional Engagement of the drive rolls with the driven built roll by eliminating slip and maintaining a static coefficient of friction.

Currently, the industry standard is to rely on predefined "recipes" to manage winding operations. These recipes specify variable arrays such as front drum torque and Rider Roll pressure profiles to accommodate different paper types. However, this approach lacks flexibility and fails to account for real-time variations in material properties or environmental conditions like humidity. As a result, issues such as Interweaving, Slippage, excessive vibration, and misalignment frequently occur during the winding process. These problems not only compromise roll quality but also increase downtime and operational inefficiencies.

Existing solutions for improving Frictional Engagement during the winding process often involve applying a metal spray to create a "traction coating" to the drive drums. While this method increases the friction coefficient of the drive drums, it comes with significant drawbacks. The traction coating frequently leaves indents or marks on the paper surface, compromising the quality of the final product. This is particularly problematic for paper products requiring smooth or uniform finishes, such as coated or laminated sheets. Additionally, these coatings may wear unevenly over time, leading to inconsistent performance and necessitating frequent maintenance. It is clear that additional innovation is needed.

Inventor'S Expertise

The inventor, an electrical engineer with more than four decades of experience in the paper industry, has extensive knowledge of material winding systems and their operational challenges. This expertise has informed the development of this Adaptive Winding System, addressing long-standing inefficiencies in Paper Web winding processes.

SUMMARY OF THE INVENTION

This invention provides an Adaptive Winding System tailored for paper products and their derivatives. It dynamically adjusts key operational variables-Front Drum torque (FDT), Rider Roll pressure (RRP), unwind tension (UT), Acceleration Rate and Jerk Rate, and sheet speed—to optimize Frictional Engagement during the winding process. The system includes:

- A Front Drum with adjustable torque control and regulation;
- A Back Drum, the winder speed master
- A Rider Roll with variable pressure control and regulation;
- An Unwind Section with tension control and regulation;
- A Control Unit that processes Sensor Operational Data to dynamically maximize coupling between drive roll and driven paper roll.

By automating adjustments in real time, operators benefit from a safer and more streamlined process, leading to greater job satisfaction. The Adaptive Winding System significantly enhances the efficiency and reliability of paper winding operations. Additionally, the percentage of high-quality rolls increases and the percentage of defective rolls decreases. The automated nature of the system allows it to react dynamically to Sensor feedback, ensuring optimal performance and consistent roll quality.

- UW: (100) Unwind Section-Incoming Jumbo roll to be slit into smaller rolls. Variable diameter, regulates web tension;
- T: (101) Tension Sensor-Measures web tension between UW and BD;
- SS: (102) Non-contact Sheet Speed Sensor-Speed measurement of the sheet;
- BD: (103) Back Drum-Winder speed control Master roll;
- FD: (104) Front Drum-Adjustable torque follower of Back Drum;
- BR: (105) Built Roll-Roll created during the winding process;
- RR: (106) Rider Roll-Applies variable force down onto the Built Roll (BR);
- UWSS: (107) Unwind Motor Speed feedback Sensor;
- BDSS: (108) Back Drum Motor Speed feedback Sensor;
- FDSS: (109) Front Drum Motor Speed feedback Sensor;
- CU: (110) Control Unit-Processes Sensor Operational Data to detect slip conditions, surface properties, Acceleration Rate, Jerk Rate and adjusts Operational Parameters dynamically;
- CS: (111) Communication System utilized by the Control Unit and winder process.

Figure 2:
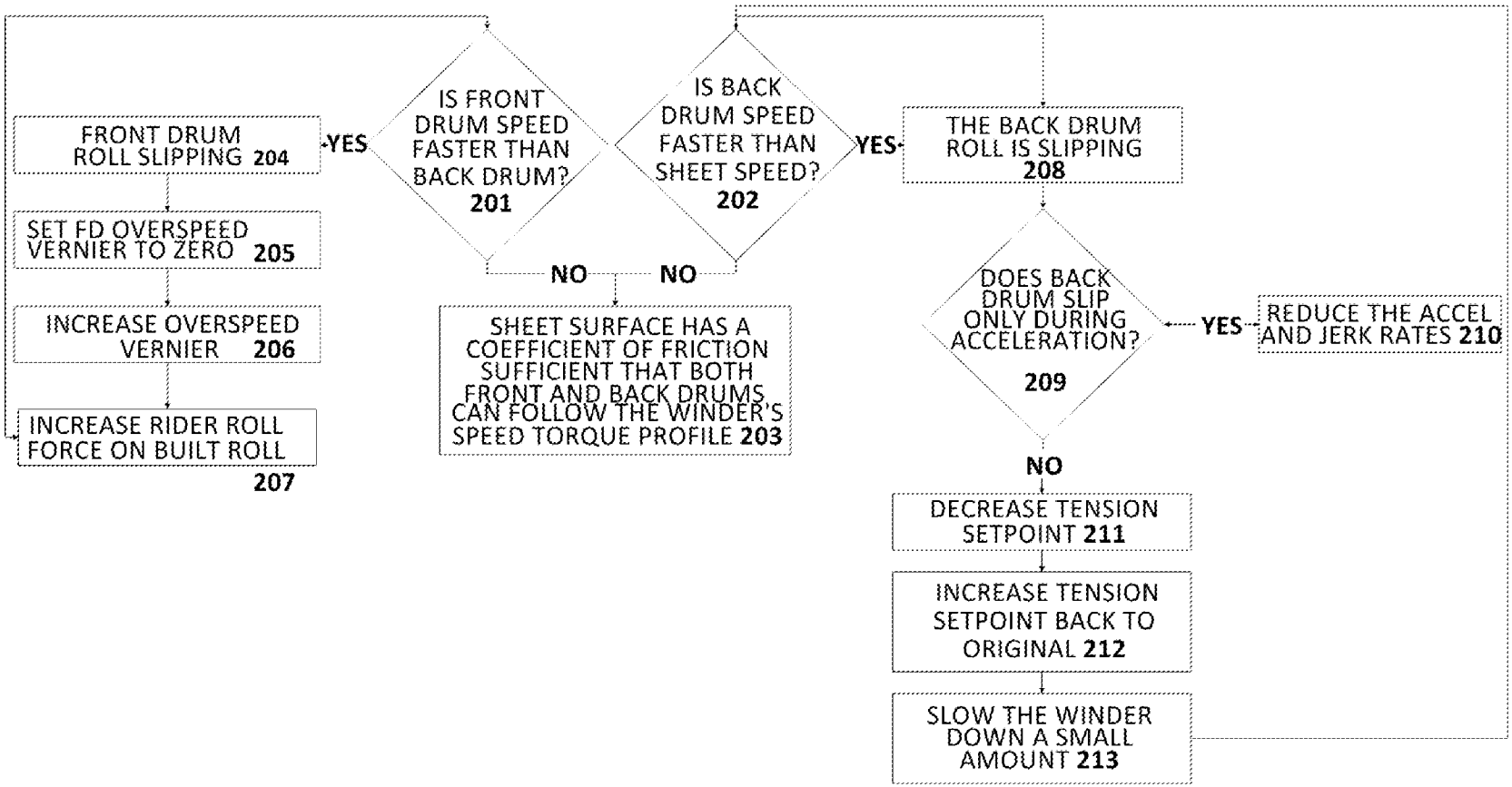

FIG. 2 is a flow diagram illustrating the feedback loop used by the Control Unit to adjust Operational Parameters based on real-time Sensor Operational Data.

DETAILED DESCRIPTION OF THE INVENTION

Definitions

For clarity and consistency, the following terms are defined as used in this document:

1. Adaptive Winding System: A system designed to dynamically adjust Operational Parameters during the winding of paper products to optimize performance.

2. Paper Web: A continuous sheet of paper or paper-based material processed during winding operations.

3. Paper Web Winder: A machine that partitions a single large paper roll into multiple smaller rolls of varying widths and diameters.

4. Frictional Engagement: The coupling between the Paper Web and the drive rolls.

5. Coefficient of Friction: A measure of resistance to sliding between two surfaces, in this invention specifically between the Paper Web and drive rolls.

6. Operational Parameter: At least one of the following variables: torque, pressure, tension, sheet speed, Acceleration Rate, and Jerk Rate.

7. Front Drum (FD): One of the winder drive rolls. It is a torque follower of the Back Drum. Its primary function is to maintain a tight wrap on the Built Roll. The Front drum only contacts the Built Roll in a narrow sheet width line and so is most susceptible to Slippage.

8. Back Drum (BD): One of the winder drive rolls. The master speed control roll of the winder. The Back Drum roll has a high amount of Frictional Engagement with the Paper Web but under the right conditions the web will slip on it as well. The Back Drum torque will vary to whatever is required to maintain the speed and tension setpoints.

9. Rider Roll (RR): A roll that applies variable pressure on the built roll to maintain the Frictional Engagement between the Paper Web and the Front and Back Drive drums. The goal is to ensure consistent winding and prevent Slippage or Interweaving.

10. Unwind Section (UW): The part of the system that regulates feed rate and maintains consistent web tension as the Paper Web enters the winding process.

11. Sensor: A device that detects physical parameters and transmits that information to a Control Unit.

12. Sensors: One or more devices that detects physical parameters and transmits that information to a Control Unit.

13. Control Unit (CU): A processing unit that modifies Operational Parameters in response to Operational Data.

14. Closed-Loop Feedback Control: A control mechanism where real-time Sensor Operational Data is continuously used to adjust Operational Parameters for optimal performance.

15. Acceleration Rate: The rate at which speed changes over time.

16. Jerk Rate: The rate at which acceleration changes over time.

17. Interweaving: Undesired cross machine movement of the Paper Web resulting in overlapping or entanglement of the Paper Web layers interlocking two separate rolls.

18. Slippage: The unintended movement or sliding of the Paper Web in both the machine and cross-machine directions relative to the drive rolls due to insufficient Frictional Engagement.

19. Operational Data: Information generated, collected, or processed during the operation of the Paper Web Winding system. This includes, but is not limited to, Sensor readings (e.g., tension, speed, torque), machine parameters (e.g., Drum Speeds, Rider Roll pressure), environmental factors (e.g., humidity, temperature), system adjustments (e.g., changes to torque or tension setpoints), historical performance metrics, and any information derived from real-time feedback or predictive algorithms. Operational Data encompasses both raw and processed information used to monitor, control, optimize, and analyze the performance of the winding system under varying conditions.

20. Artificial Intelligence (AI): Computational systems or techniques designed to perform tasks that typically require human intelligence, such as decision-making, pattern recognition, prediction, or optimization. This includes machine learning algorithms, which are models that analyze Operational Data to identify patterns and improve performance over time without explicit programming, as well as other techniques such as neural networks, deep learning, and rule-based systems.

21. Winding Recipes: Predefined sets of operational parameters and profiles used by an operator or operators of a Paper Web Winder to guide the winding process under specific conditions.

System Components

1. Front Drum (FD): Configured with an adjustable torque mechanism to regulate Frictional Engagement and maximize coupling with Paper Web surfaces. Slippage is determined by comparing the Front Drum Speed to the Back Drum or the non-contact sheet speed Sensor.

2. Back Drum (BD): The speed master roll. Slippage is determined by comparing the Back Drum Speed to the non-contact sheet speed Sensor.

3. Rider Roll (RR): Applies variable pressure using actuators controlled by real-time feedback from at least one Sensor to manipulate the force compressing the Paper Web down onto the Front and Back drive rolls to increase Frictional Engagement.

4. Unwind Section (UW): A drive roll containing the large jumbo roll being spooled off. The Unwind roll's diameter and inertia decrease during the winding process. The Unwind section controls the tension of the Paper Web.

5. Sensor(S): Detect key parameters such as:

Paper Web tension
Paper Web actual speed (non-contact sensor)
Rider Roll pressure feedback
Built Paper roll diameter
Drive Rolls Speed and Torque 6. Control Unit (CU): Processes Sensor Operational Data using pre-programmed algorithms or machine learning models for dynamic adjustments.

Operation

1. Paper enters from the Unwind Section (UW), where tension is regulated primarily through math calculations using the rate of acceleration, the Unwind roll's moment of inertia, and torque feedback in combination with a secondary tension vernier using load cells tension feedback.

2. The Back Drum (BD) Has the most paper wrap and is the winder speed master. It applies whatever torque is required to follow the winder speed and tension profile.

3. The Front Drum (FD) Is primarily used to maintain a tight outer wrap on the Built paper roll. The Front Drum follows the torque of the Back Drum using an array or formula based on the diameter of the Built Roll. The addition of the Front and Back Drum torques is proportional to the total tension.

4. The Rider Roll (RR) applies variable pressure on the built roll being formed. As with the Front Drum, the Rider Roll pressure follows an array or formula based on the Built Roll diameter.

5. Adjustments are performed dynamically using Closed-Loop Feedback Control managed by the Control Unit (CU).

Embodiments of the Invention

In one embodiment, when the Front Drum [104] is slipping, the Front Drum [104] torque is reduced to restore frictional engagement; in another embodiment, when the Back Drum [103] is slipping, the Unwind Tension is reduced to restore frictional engagement. In one embodiment, when the Rider Roll [106] detects insufficient pressure on the Built Roll [105], its applied force is increased to ensure consistent coupling between the Paper Web and the drive rolls; In one embodiment, when the Tension Sensor [101] identifies rapid fluctuations (chatter) in web tension, it signals adjustments to both the tension and Winder speed setpoints to stabilize operations.

In one embodiment, when the Control Unit detects that the Front Drum [104] Speed exceeds the Back Drum [103] Speed as indicated by [201], it identifies Slippage on the Front Drum [104] and initiates corrective actions. These actions include resetting the Front Drum [104] overspeed vernier to zero as per [205] and then gradually increasing it back the original value to restore proper frictional engagement as indicated by [206]. In another embodiment, if Slippage persists despite these adjustments as a secondary procedure, the Rider Roll [106] force applied to the Built Roll [105] is very slowly increased as per [207] to restore frictional engagement between the Front Drum [104] and the Built roll [105].

In one embodiment, when the Front Drum [104] experiences Slippage due to insufficient frictional engagement with the Paper Web, its torque is decreased dynamically by the Control Unit [110] to restore proper coupling; in another embodiment, if Slippage persists despite torque reduction, as a secondary procedure, the Rider Roll [106] pressure is increased to compress the Built Roll [105] more firmly against the Front Drum [104] to restore frictional engagement between the Front Drum [104] and the Built roll [105].

In one embodiment, when the Non-Contact Sheet Speed Sensor [102] indicates that the Back Drum [103] Speed is going faster than the actual sheet speed, indicating Slippage, it signals adjustments to the tension and Winder speed setpoints to restore frictional engagement between the Back Drum [103] and the Paper Web; in another embodiment, if the Back Drum [103] slippage occurs only when the winder is accelerating, then the acceleration and jerk ates are dynamically optimized by the Control Unit [110].

In one embodiment, when [202] identifies that the Back Drum [103] Speed is faster than the actual sheet speed, indicating Slippage on the Back Drum [103] roll, the tension setpoint is decreased slightly as per [209] to restore frictional engagement between the Paper Web and the Back Drum [103]. In another embodiment, after reducing the tension setpoint, it is slowly increased back to its original value at [210] to ensure consistent winding. If persistent Slippage on the Back Drum [103] continues despite reducing the tension, the winder is slowed down very gradually as indicated by [211] as a secondary procedure to restore frictional engagement between the Paper Web and the Back Drum [103].

In one embodiment, when [202] determines that neither drum is slipping and that sufficient friction exists for both drums to follow the winder's recipe for speed and torque profiles as per [203], no further adjustments are made. In another embodiment, this condition triggers a verification process where Sensor Operational Data is logged for this specific grade of paper for future analysis of optimal Operational Parameters.

In one embodiment, when Slippage conditions are detected by any Sensor within the system (e.g., Tension Sensor [101], Non-Contact Sheet Speed Sensor [102]), the Control Unit [110] processes this Operational Data using pre-programmed algorithms or machine learning models and adjusts at least one Operational Parameter such as torque, pressure, tension, speed dynamically to restore frictional engagement.

Figure 1:
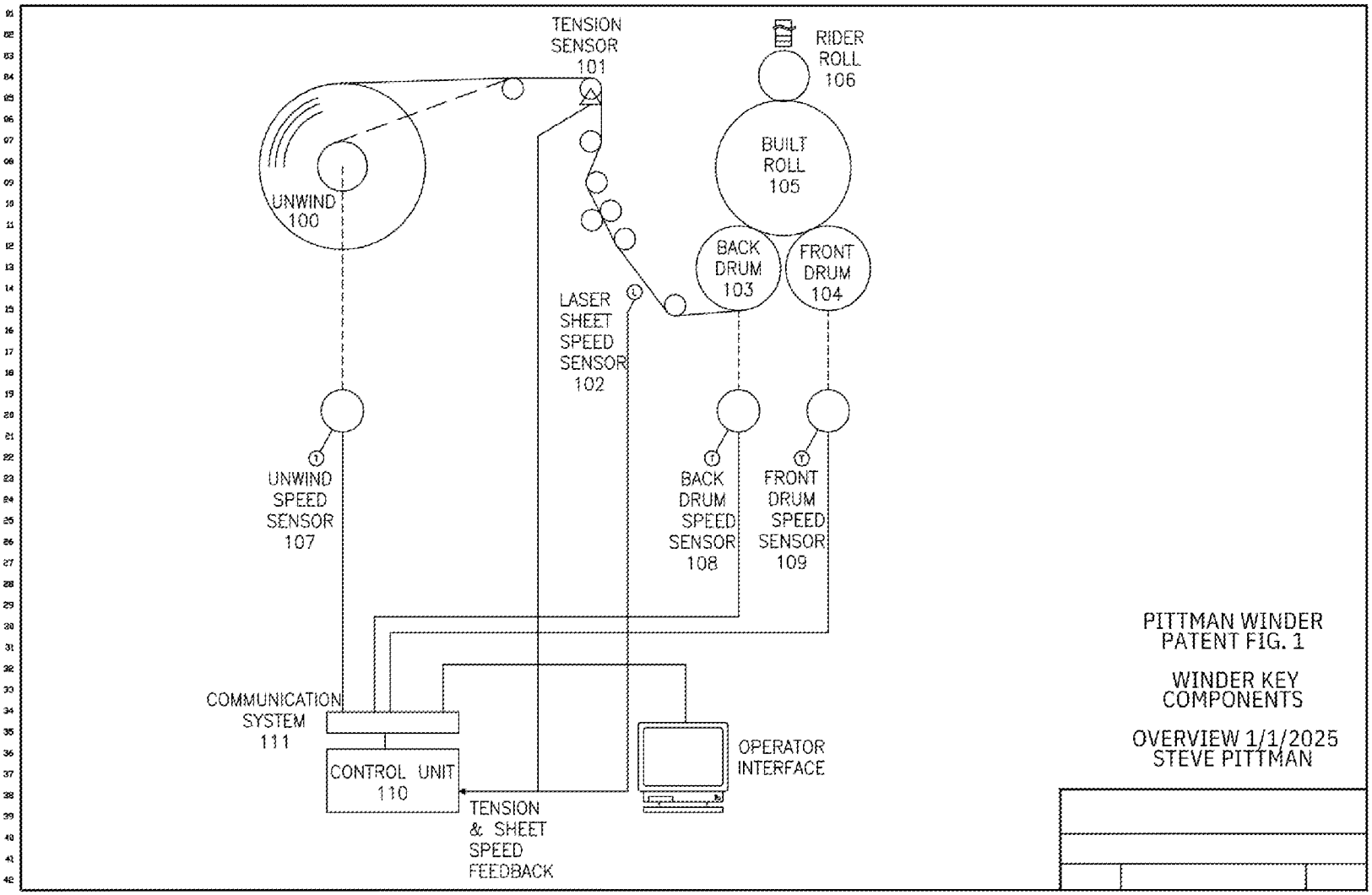
FIG. 1 is a schematic diagram illustrating the key components of the adaptive material winder system.

In one embodiment, when auxiliary Sensors detect anomalies such as uneven roll buildup or misalignment during winding operations as indicated by FIG. 1's feedback loop system architecture, corrective actions include modifying Rider Roll [106] pressure, Front Drum [104] torque, or tension dynamically; in another embodiment, these anomalies trigger an automated alert system that provides operators with recommended adjustments based on historical Operational Data stored within the Control Unit.

In another embodiment, these algorithms use historical Operational Data stored within the system to predict optimal parameter adjustments for the winding process. In one embodiment, when vibrations or interweaving occur during winding due to improper frictional engagement between drive rolls and Paper Web layers, adjustments are made dynamically using these predictions in order to resolve the vibration or interweaving issue.

In one embodiment, when material properties such as surface roughness or coating type vary across different batches of paper products being processed through the winder, Operational Parameters such as speed, tension, pressure, and drum torques are adjusted dynamically to achieve maximum coupling for each batch; in another embodiment, historical Operational Data combined with machine learning algorithms within the Control Unit [110] analyze these variations over time to improve the winding quality and performance in the future; in another embodiment, operators can manually input custom recipes tailored for unique material properties or customer requirements based on this historical Operational Data.

In one embodiment, the system leverages AI-driven optimization to fine-tune the Rider Roll [106] pressure, Front Drum [104] torque, and tension profiles based on feedback from Sensors monitoring Built Roll [105] diameter, ensuring optimal frictional engagement throughout the winding process; in another embodiment, machine learning algorithms analyze the paper grade being wound and its historical roll quality Operational Data to recommend ideal profiles for specific paper types or environmental conditions.

In one embodiment, advanced AI models analyze historical production Operational Data alongside real-time Sensor inputs from components like the Tension Sensor [101] and Non-Contact Sheet Speed Sensor [102] to optimize profiles for different paper types or roll diameters; in another embodiment, these profiles are dynamically adjusted during operation based on feedback from motor speed Sensors (UWSS [107], BDSS [108], FDSS [109]).

In one embodiment, Artificial Intelligence algorithms process Operational Data from the Non-Contact Sheet Speed Sensor [102] to detect patterns of Slippage on the Front Drum [104] or Back Drum [103], enabling preemptive adjustments to drum torque or Rider Roll [106] pressure; in another embodiment, these algorithms identify anomalies in sheet speed and recommend optimal Operational Parameters for improved performance.

In one embodiment, Artificial Intelligence integrated into the Communication System [111] provides operators with real-time visualizations of system performance metrics such as tension stability and roll quality consistency; in another embodiment, this AI system generates predictive alerts for potential issues like Slippage or misalignment, allowing operators to take corrective action before problems escalate. In one embodiment, machine vision systems analyze surface properties of the Paper Web as it passes through the Unwind Section [100], detecting defects or inconsistencies that could affect winding performance; in another embodiment, this analysis is combined with real-time adjustments to drum torque and Rider Roll [106] pressure to mitigate the impact of detected defects.

In one embodiment, machine vision systems integrated into FIG. 2's architecture analyze surface properties of the Paper Web as it enters the Unwind Section [100]. Detected defects trigger automatic adjustments to drum torque and Rider Roll [106] pressure to mitigate their impact on roll quality. In another embodiment, this analysis is combined with historical Operational Data to develop predictive models for future production runs.

In one embodiment, smart materials are used to construct the Front Drum [104] and Back Drum [103] surfaces, allowing them to dynamically alter their Coefficient of Friction in response to feedback from FIG. 2's feedback loop. This ensures consistent frictional engagement regardless of changes in material properties or environmental conditions. In another embodiment, these smart materials are controlled by AI-driven actuators that respond instantly to Sensor Data.

The invention claimed is:

1. An adaptive winding system comprising: one or more drive rolls; one or more sensors configured to detect actual web speed; and a control unit configured to detect slippage by comparing the actual web speed to the speed of the one or more drive rolls, and to adjust one or more operational parameters based on real-time feedback from the one or more sensors to restore frictional engagement.

2. The adaptive winding system of claim 1, wherein the one or more operational parameters include torque, pressure, tension, web speed, acceleration rate, jerk rate, or a combination thereof.

3. The adaptive winding system of claim 1, further comprising a rider roll configured to apply variable pressure on a built roll to maintain frictional engagement.

4. The adaptive winding system of claim 1, wherein the one or more sensors include a non-contact web speed sensor, a tension sensor, or a combination thereof.

5. The adaptive winding system of claim 1, wherein the one or more operational parameters are adjusted in response to one or more machine learning algorithms.

6. The adaptive winding system of claim 1, further comprising a communication system configured to provide real-time visualizations of system performance metrics, predictive alerts, or a combination thereof, for potential slippage, misalignment, or a combination thereof.

7. A method for an adaptive winding system comprising: detecting slippage between a web and one or more drive rolls by comparing data from one or more sensors; and dynamically adjusting one or more operational parameters to restore frictional engagement between the web and the one or more drive rolls.

8. The adaptive winding system of claim 1, wherein slippage conditions between a web and a rotating component are detected by comparing operational data from one or more sensors monitoring actual web speed to operational data from one or more sensors monitoring drum speed, and adjustments to operational parameters are performed in real time.

9. The adaptive winding system of claim 1, further comprising an unwind section configured to regulate web tension upstream of a built roll using feedback from tension sensors and unwind motor speed sensors.

10. The adaptive winding system of claim 1, wherein adjustments include recalibrating acceleration rate, jerk rate, or a combination thereof, to prevent slippage.

11. The method of claim 7, wherein the adjusting uses one or more machine learning algorithms to analyze one or more patterns in operational data and adjust one or more operational parameters in response to the operational data.

12. The method of claim 7, further comprising logging operational data for creation, optimization, or a combination thereof, of winding recipes.

13. The method of claim 7, further comprising modifying rider roll pressure based on feedback from one or more sensors.

14. The method of claim 7, wherein detecting slippage includes identifying when a front drum speed exceeds a back drum speed, and dynamically adjusting includes adjusting front drum torque to restore frictional engagement.

15. The method of claim 7, wherein detecting slippage includes identifying when a back drum speed exceeds the actual web speed, and dynamically adjusting includes reducing unwind tension to restore frictional engagement.

16. The method of claim 7, further comprising using one or more machine learning algorithms to predict adjustments to operational parameters based on historical operational data for different paper types, environmental conditions, or a combination thereof.

17. A system comprising: a drive roll; a sensor configured to measure web speed; and a control unit to detect slippage based on a discrepancy between the measured web speed and the drive roll speed, and to adjust a parameter accordingly.

18. The adaptive winding system of claim 1, wherein the control unit uses one or more machine learning algorithms to analyze patterns in operational data and adjust one or more operational parameters to restore frictional engagement.

19. The adaptive winding system of claim 1, further comprising a memory configured to log operational data for creation, optimization, or a combination thereof, of winding recipes.

20. The adaptive winding system of claim 1, wherein the control unit is configured to detect vibrations, interweaving, or a combination thereof, based on real-time feedback from one or more sensors.

* * * * *